US005147149A

United States Patent [19]

Craig et al.

[11] Patent Number: 5,147,149

[45] Date of Patent: Sep. 15, 1992

[54] TENSION LEG DEWATERING APPARATUS AND METHOD

[75] Inventors: Steven M. Craig, Terryville, Conn.; Douglas H. Warren, West Springfield, Mass.; Lee M. Sandora, East Granby; Robert R. Masecar, Meriden, both of Conn.; Norman W. Hein, Katy; Andrew F. Hunter, Houston, both of Tex.

[73] Assignee: Conoco Inc., Ponca City, Okla.

[21] Appl. No.: 701,498

[22] Filed: May 16, 1991

[51] Int. Cl.[5] ..... E02B 17/02

[52] U.S. Cl. ..... 405/223.1; 405/224; 166/68; 166/107; 417/423.3

[58] Field of Search ..... 405/223.1, 11, 224, 405/249, 195.1; 166/68, 69, 105, 107; 417/423.3

[56] References Cited

U.S. PATENT DOCUMENTS

| | | | |
|---|---|---|---|
| 892,093 | 6/1908 | Sillett | 166/68 |
| 1,235,112 | 7/1917 | Coberly | 166/68 |
| 1,616,219 | 2/1927 | Franklin | 166/68 |
| 2,890,756 | 6/1959 | Middleton | 166/107 |
| 3,045,607 | 7/1962 | Lindner | 166/68 |
| 3,474,737 | 10/1969 | Norman et al. | 417/53 |
| 4,187,912 | 2/1980 | Cramer | 166/107 X |
| 4,190,113 | 2/1980 | Harrison | 166/107 X |
| 4,293,288 | 10/1981 | Weber | 417/423.3 X |
| 4,626,136 | 12/1986 | Gunderson | 405/223.1 |
| 4,711,299 | 12/1987 | Caldwell et al. | 166/107 X |
| 4,747,451 | 5/1988 | Adams et al. | 166/105 X |
| 4,784,529 | 11/1988 | Hunter | 405/227 |
| 4,844,659 | 7/1989 | Hunter et al. | 405/224 |

FOREIGN PATENT DOCUMENTS 565118 8/1977 U.S.S.R. .

OTHER PUBLICATIONS

Exhibit A—Brochure of the Cavins Company entitled "Sand Pump Model 'C' 3¾" O.D.—Instruction Manual and General Information (undated but admitted to be prior art.

Exhibit B—Brochure illustrating ABS sump pump Model No. CD-5W (undated but admitted to be prior art).

*Primary Examiner*—Randolph A. Reese
*Assistant Examiner*—Arlen L. Olsen

[57] ABSTRACT

An apparatus and method are provided for dewatering an interior of a hollow tension leg connecting a tension leg platform to a floor of a body of water. The apparatus includes a pump having a suction inlet defined on its lower end and a discharge outlet on its upper end. An elongated storage tank is attached to the upper end of the pump above the pump and has a tank interior communicated with the discharge outlet. The assembly is lowered on an electric wireline through which power is conducted to the pump. The pump fills the tank and then the assembly is withdrawn from the tension leg and the water is drained therefrom. The assembly can be repeatedly lowered into the tension leg and withdrawn therefrom until the tension leg is substantially completely dewatered. Solid debris can be removed from the tension leg prior to dewatering.

27 Claims, 9 Drawing Sheets

TENSION LEG DEWATERING APPARATUS AND METHOD

BACKGROUND OF THE INVENTION

1. Field of the Invention

The present invention relates generally to methods and apparatus for removing water from an elongated tubular member in place within a body of water.

2. Description of the Prior Art

The prior art includes numerous types of downhole pumps for pumping various liquids up out of a well. These pumps uniformly are used in conjunction with a conduit through which the liquids are pumped to the surface. Representative examples of such downhole pumps are shown in the following:

1. U.S. Pat. No. 3,474,737 to Norman et al.;
2. U.S. Pat. No. 3,045,607 to Lindner;
3. U.S. Pat. No. 1,616,219 to Franklin;
4. U.S. Pat. No. 1,235,112 to Coberly;
5. U.S. Pat. No. 892,093 to Sillett; and
6. Russian Patent No. 565,118.

The prior art also includes sand pumps and other "fishing tools" utilized to remove sand and other debris from a well. Typical of such equipment is that sold by The Cavins Company of 2853 Cherry Avenue, Long Beach, Calif. 90806, as its "Cavins Sand Pumps" with assorted junk baskets and other accessories.

The prior art also includes sump pumps having a suction inlet on their lower end and a discharge outlet on their upper end, such as the ABS Pump Model No. CD-5W manufactured by ABS Pumps of 140 Pond Road, Meriden, Conn. 06450.

The prior art also includes tension leg platform structures having hollow tubular tension leg members with irregular internal diameters such as shown in U.S. Pat. Nos. 4,844,659 to Hunter et al. and 4,784,529 to Hunter.

SUMMARY OF THE INVENTION

The present invention is directed to methods and apparatus for substantially completely eliminating all of the liquids from the interior of an elongated tubular member, and particularly from the interior of a tubular tension leg of a tension leg platform which is in place anchoring the tension leg platform to the ocean floor.

The preferred apparatus includes a pump having a suction inlet at its lower end and a discharge outlet at its upper end. An elongated storage tank is attached to the upper end of the pump and the pump and has an interior communicated with the discharge outlet. A wireline connector connects the pump and the storage tank to a wireline so that the pump and the storage tank can be lowered and raised with the wireline.

This apparatus provides a means for substantially completely dewatering an interior of a hollow tension leg connecting a tension leg platform to a floor of a body of water.

In conjunction with the dewatering of the tension leg, it is preferable to first remove any solid debris from the interior of the tension leg.

Methods of using the apparatus include lowering of the elongated pump and storage tank assembly into the interior of the hollow tension leg. Then water is pumped from the interior of the tension leg into the storage tank with the pump. Then the storage tank and pump assembly are retrieved from the hollow tension leg thereby removing water from the interior thereof.

The storage tank can then be drained and the process repeated as necessary.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
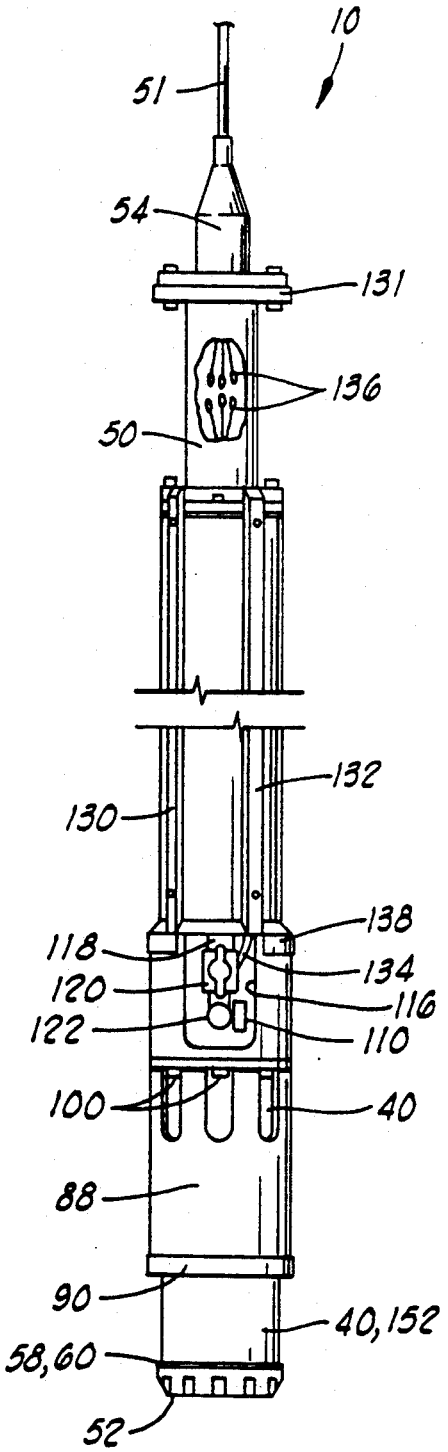
FIG. 1 is an elevation view of the apparatus of the present invention.
Figure 2:
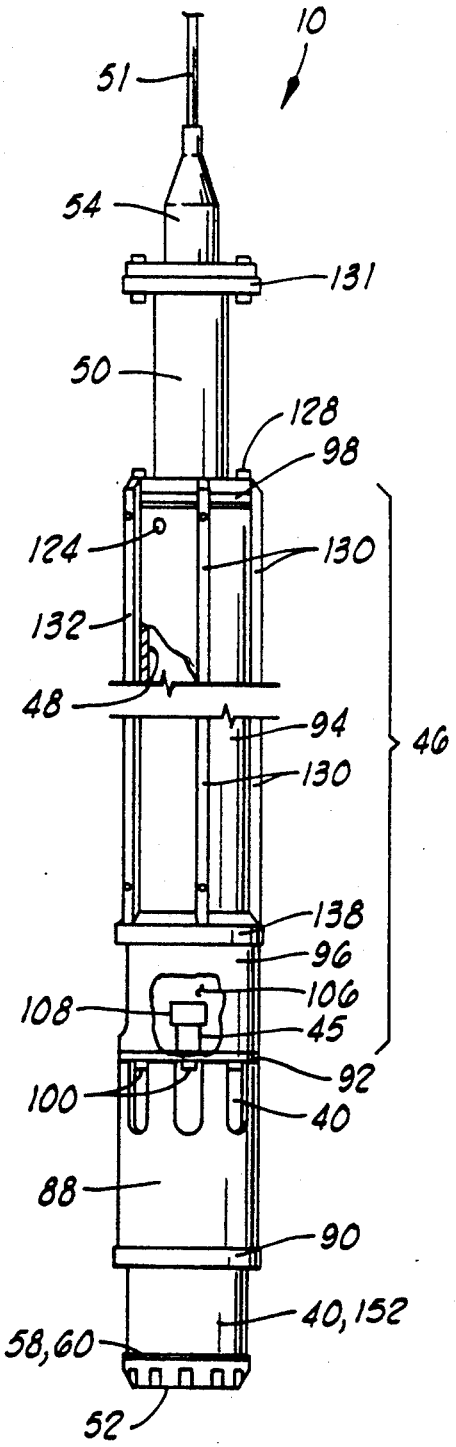
FIG. 2 is a view of the apparatus of FIG. 1 rotated 90° and partially cut away to show interior details.

Referring now to the drawings and particularly to FIGS. 1 and 2, an apparatus for removing liquids from an elongated tubular member is shown and is generally designated by the numeral 10. The apparatus 10 is particularly constructed for removing water from an interior of a hollow tension leg connecting a tension leg platform to a floor of a body of water. Such a tension leg platform and the tension legs associated therewith are shown in FIGS. 13, 14 and 15.

Figure 13:
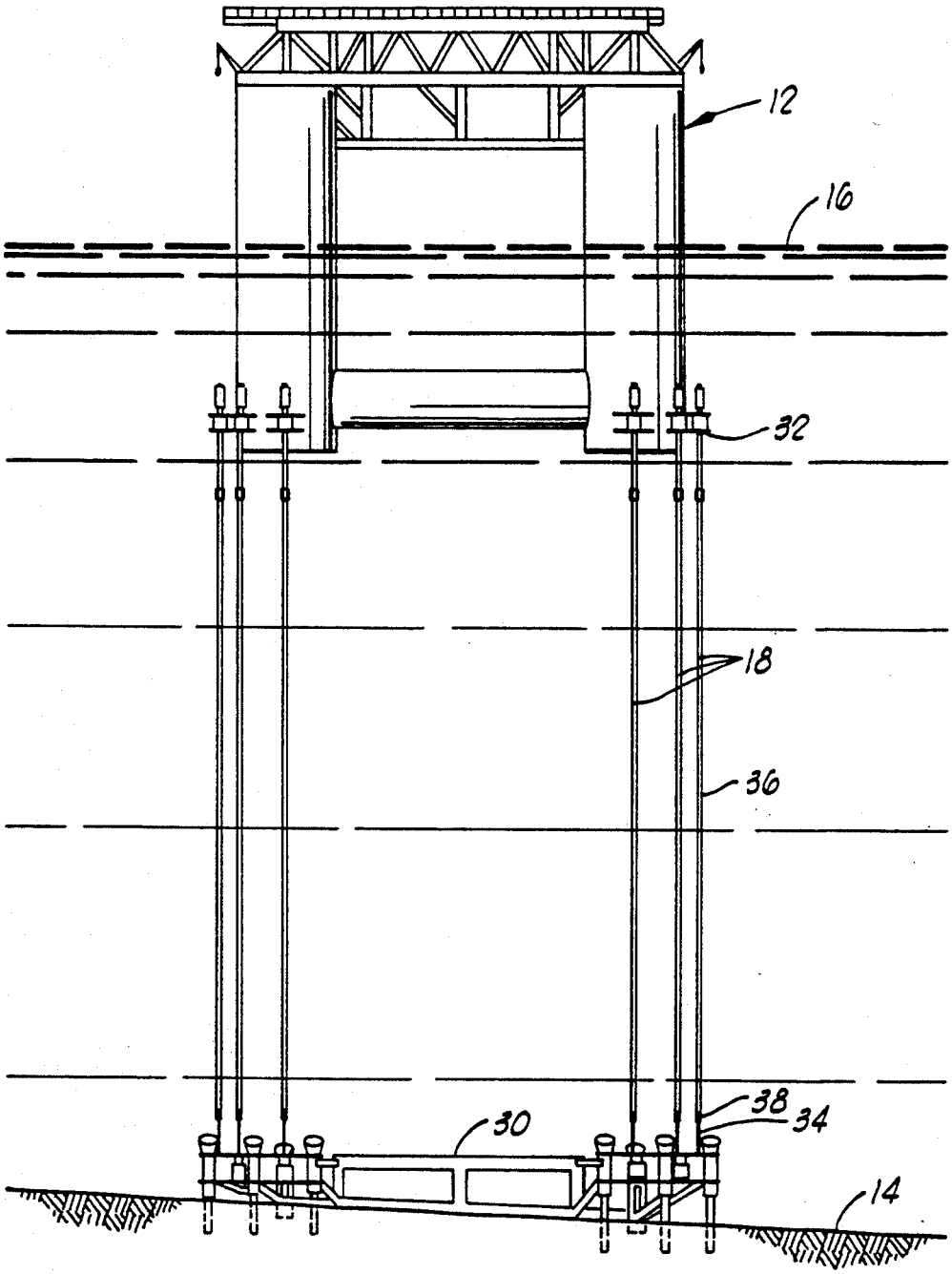
FIG. 13 (PRIOR ART)
FIG. 13 is an elevation somewhat schematic view of a tension leg platform anchored in place on the ocean floor. The tension leg platform shown in FIG. 13 is a part of the prior art as previously disclosed in U.S. Pat. No. 4,844,659 to Hunter et al.

FIG. 13 shows a tension leg platform generally designated by the numeral 12 anchored to the floor 14 of a body of water such as the ocean 16 by a plurality of hollow tubular tension legs generally designated by the numeral 18. In the particular tension leg platform illustrated in FIG. 13, there are twelve such tension legs, being located in groups of three at the corners of the tension leg platform.

Figure 14:
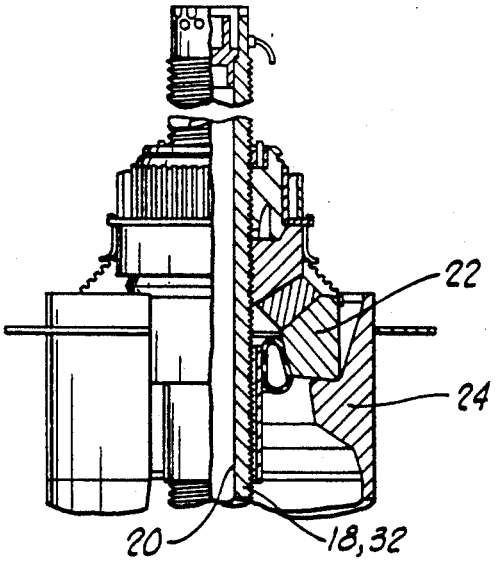
FIG. 14 (PRIOR ART)
FIGS. 14 and 15 are elevation sectioned views of the upper and lower ends, respectively, of a hollow tension leg of the prior art as utilized with the tension leg platform like that of FIG. 13.

FIG. 14 is an elevation partially sectioned view of an upper end portion of one of the tension legs 18. The tension leg 18 is a hollow tubular member having a hollow interior 20. Attached to the tension leg 18 is an upper end connector 22 which rests within a receptacle 24 which is structurally affixed to the tension leg platform 12 itself.

Figure 15:
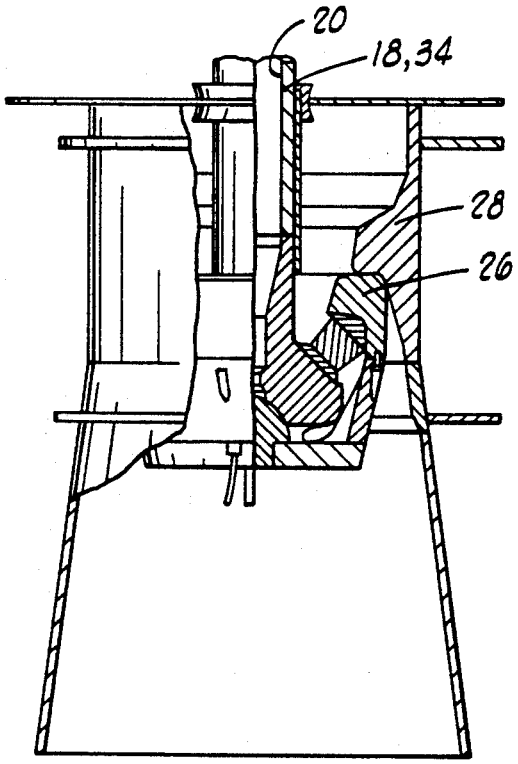
FIG. 15 (PRIOR ART)

FIG. 15 shows an elevation partially sectioned view of the lower end of tension leg 18. A lower end connector 26 is connected to the lower end of tension leg 18 and is received within a receptacle 28 which is structurally affixed to a framework 30 (see FIG. 13) which is anchored to the ocean floor 14. As can be seen in FIG. 13, the tension leg 18 has reduced diameter upper and lower portions 32 and 34, respectively, with the major portion of the length of the leg being made up by an enlarged diameter intermediate portion 36 which is connected to the reduced diameter portions by transition elements such as 38. Thus, the tension leg 18 has a hollow interior of varying diameter. The inside diameter of the intermediate portion 36 is approximately twenty-two inches and the inside diameter of the upper and lower portions 32 and 34 are approximately nine inches.

The structure shown in FIGS. 13–15 is a part of the prior art.

Figure 20:
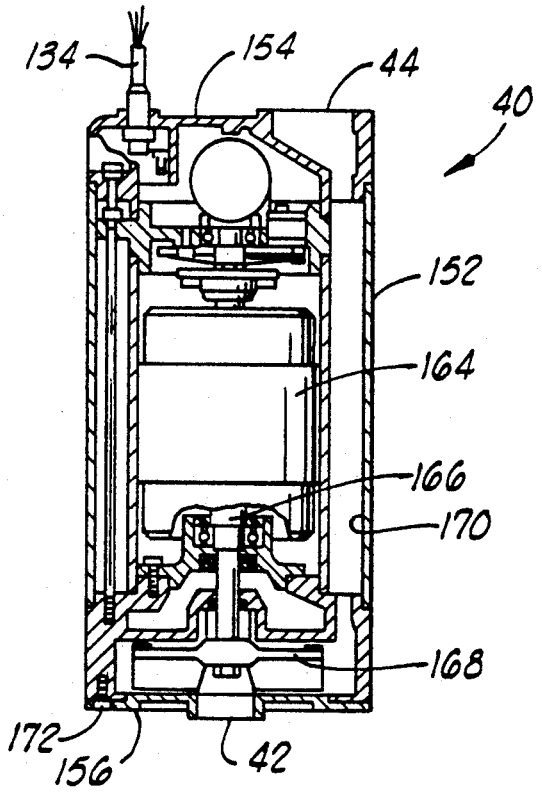
FIG. 20 is an elevation section view of the pump used in the apparatus of FIGS. 1 and 2.

Turning now to FIGS. 1 and 2, the apparatus 10 includes a pump 40 near its lower end. The details of construction of pump 40 are seen in FIG. 20. The pump 40 has a suction inlet 42 at its lower end and a discharge outlet 44 at its upper end. An elongated storage tank 46 is connected to the upper end of pump 40. The storage tank 46 has an interior 48 which is communicated with the discharge outlet 44 of pump 40 as further described below.

A spool shaped wireline adapter 50 is attached to the upper end of tank 46. A wireline 51 has a wireline termination 54 attached to wireline adapter 50 so that the pump 40 and tank 46 are suspended from the wireline 51 and may be lowered into the tension leg 18 and retrieved therefrom by means of the wireline 51. The wireline 51 may be constructed generally in the manner of a standard logging cable which is modified to provide power conductors therein. The wireline 51 includes power conductors and load carrying cables, all surrounded by a helically wound armored sheath.

Figure 3:
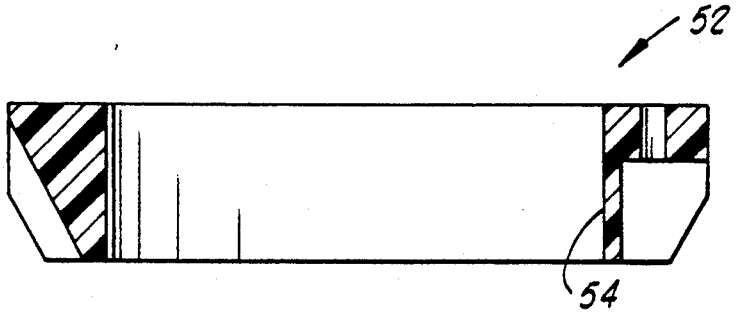
FIG. 3 is an elevation sectioned view of a nose piece utilized on the lower end of the pump.
Figure 4:
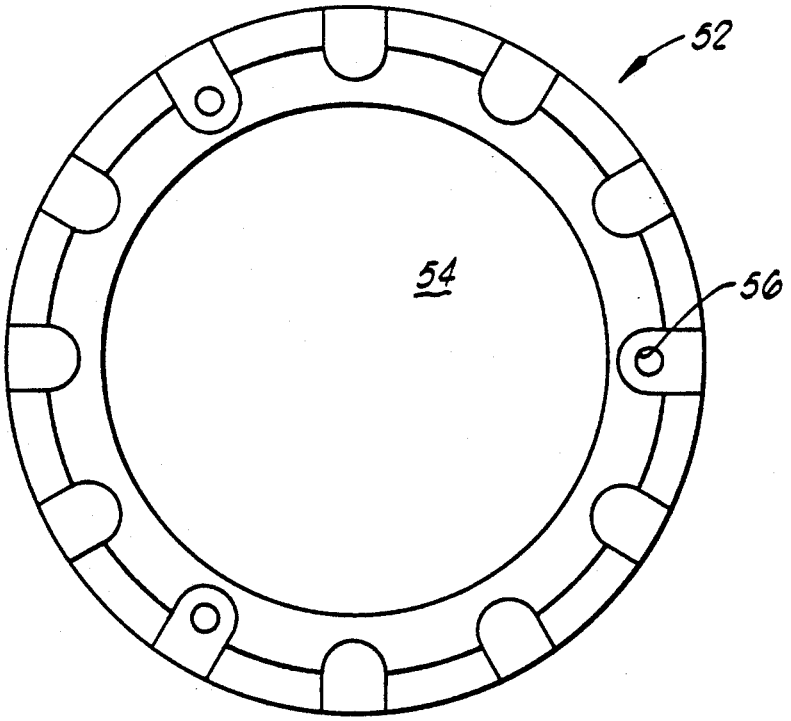
FIG. 4 is a bottom view of the nose piece of FIG. 3.

The pump 40 has a nose piece 52 attached to its lower end. The nose piece 52 is shown in section and bottom view in FIGS. 3 and 4, respectively. Nose piece 52 is manufactured of polyurethene or other similar plastic material so that it will not scuff the interior of the tension leg 18 as the apparatus 10 is moved through the tension leg 18. The nose piece 52 has a circular opening 54 therethrough. Nose piece 52 is attached to the body of pump 40 by bolts extending through attachment holes 56. As is apparent in FIGS. 1 and 2, the nose piece 52 extends radially beyond the outside diameter of the pump 40 itself.

Figure 5:
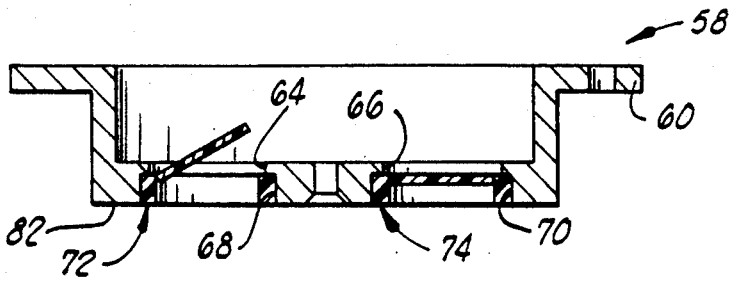
FIG. 5 is an elevation sectioned view of a pump inlet shoe utilized on the lower end of the pump.
Figure 6:
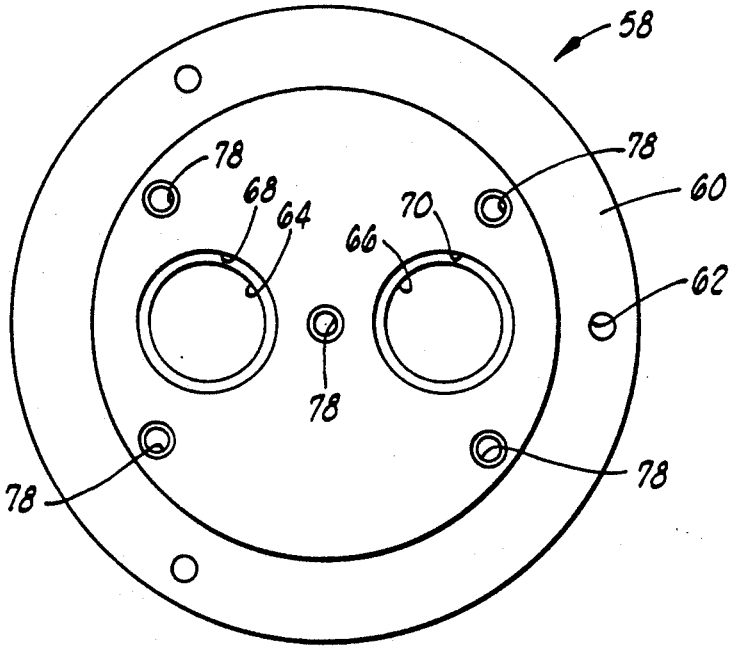
FIG. 6 is a bottom view of the pump inlet shoe of FIG. 5.

Sandwiched between the nose piece 52 and the lower end of pump 40 is a pump inlet shoe 58 which is seen in section elevation and bottom views in FIGS. 5 and 6, respectively. Pump inlet shoe 58 has a flange 60 which is visible in FIGS. 1 and 2. The bolts or other fasteners extending through the bolt holes 56 of the nose piece 52 of FIGS. 3 and 4 extend through a similar pattern of bolt holes 62 in flange 60.

Pump inlet shoe 58 has two offset bores 64 and 66 defined therethrough, with counterbores 68 and 70.

Figure 7:
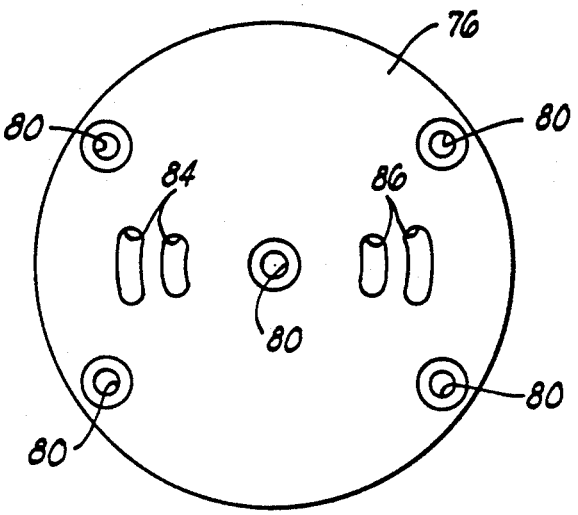
FIG. 7 is a bottom view of a screen plate utilized with the pump inlet shoe of FIG. 6.

First and second flapper type check valves 72 and 74 are disposed in counterbores 68 and 70, respectively, and are held in place therein by a screen plate 76 which is seen in FIG. 7. A pattern of five bolt holes 78 in pump inlet shoe 58 match with a similar pattern of five bolt holes 80 in screen plate 76 so as to hold the screen plate 76 in place adjacent a bottom surface 82 of pump inlet shoe 58 so as to hold the flapper valves 72 and 74 in place.

In FIG. 5, the flapper valve 72 is shown in an open position and the flapper valve 74 is shown in a closed position. In normal operation, the two valves will of course open and close substantially simultaneously.

The screen 76 has a first set of openings 84 therethrough which are aligned with bore 64, and a second set of openings 86 defined therethrough which are aligned with bore 66. The screen 76 is preferably manufactured from stainless steel plate.

When the pump 40 is operating so as to create a suction at the suction inlet 42 thereof, fluids within the tension leg will be drawn upward through the openings 84 and 86 past the flapper valves 72 and 74 and then into the suction inlet 42. When operation of the pump ceases and the pump is withdrawn from the tension leg, the flapper valves 72 and 74 will move downward to their closed position thus preventing liquids from draining from the pump 40.

A pump guard 88 surrounds the body of pump 40 and is attached thereto by set screws or the like. An annular plastic pump guard bumper 90 is disposed around the lower portion of pump guard 88. The purpose of bumper 90 is to again prevent scuffing of the interior of the tension leg 18.

Figure 8:
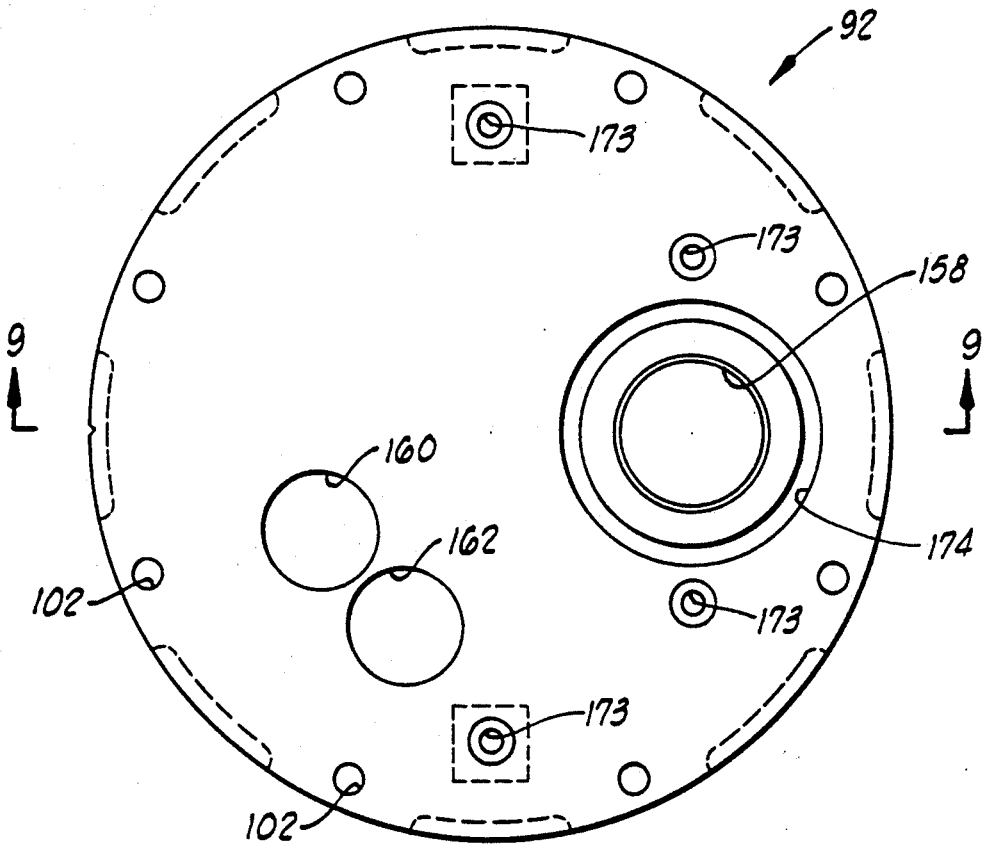
FIG. 8 is a plan view of a pump mounting plate.
Figure 9:
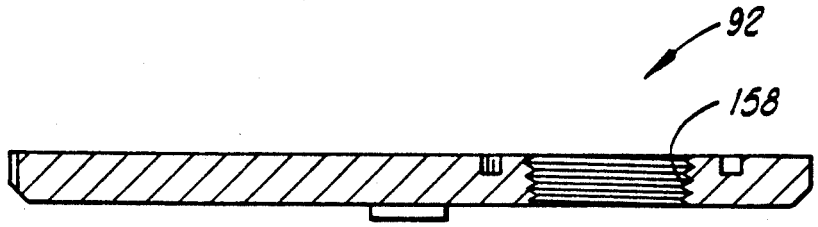
FIG. 9 is an elevation sectioned view of the plate of FIG. 8 taken along line 9—9 of FIG. 8.

The upper end of the pump 40 is attached to a pump mounting plate 92 which is best seen in plan and elevation sectioned views in FIGS. 8 and 9, respectively.

The pump 40 is best seen in FIG. 20. It includes an outer housing 152 which is visible in FIGS. 1 and 2. The housing 152 has an upper end 154 and a lower end 156. The pump guard 88 is welded to the pump mounting plate 92. The pump housing 152 is attached to pump mounting plate 92 with four screws received in holes 173 (see FIG. 8). The pump discharge outlet 44 is in registry with a threaded opening 158 (see FIG. 9) of pump mounting plate 92, and an O-ring received in groove 174 seals between pump housing 152 and mounting plate 92. Thus, the fluid discharged from pump 40 discharges through discharge outlet 44, then up through opening 158.

A discharge nipple 45 seen in FIG. 2 threads into the threaded opening 158 of pump mounting plate 92. A check valve 108 is mounted on nipple 45.

Pump mounting plate 92 further includes openings 160 and 162 defined therethrough which permit wiring to extend down to the pump 40.

The pump 40 includes an electric motor 164 which rotates shaft 166 which turns an impeller 168 which draws water up into the pump suction inlet 42 and discharges it through a discharge passage 170 leading to the pump discharge outlet 44.

The pump housing 152 has a plurality of threaded openings 172 defined in its lower end for receiving bolts which extend through the bolt holes 56 of nose piece 52 and the bolt holes 62 of pump inlet shoe 58 to hold the nose piece 52 and pump inlet shoe 58 in place adjacent the lower end of pump housing 152.

The tank 46 is made up of an elongated cylindrical pipe member 94 having a tank bottom structure 96 welded to its lower end and having a tank top plate 98 welded to its upper end. The details of construction of the tank bottom structure 96 are best seen in the elevation and bottom views of FIGS. 10 and 11, respectively.

Eight machine screws 100 extend upward through openings 102 in mounting plate 92 into threaded bores 104 in the lower end of tank bottom structure 96. The tank bottom structure 96 has a cylindrical offset opening 106 extending vertically through the entire length thereof. Opening 106 is located above opening !58 of mounting plate 92, and the fluid discharged from pump outlet 44 discharges through check valve 108 into opening 106 and thus into interior 48 of tank pipe section 44.

Figure 11:
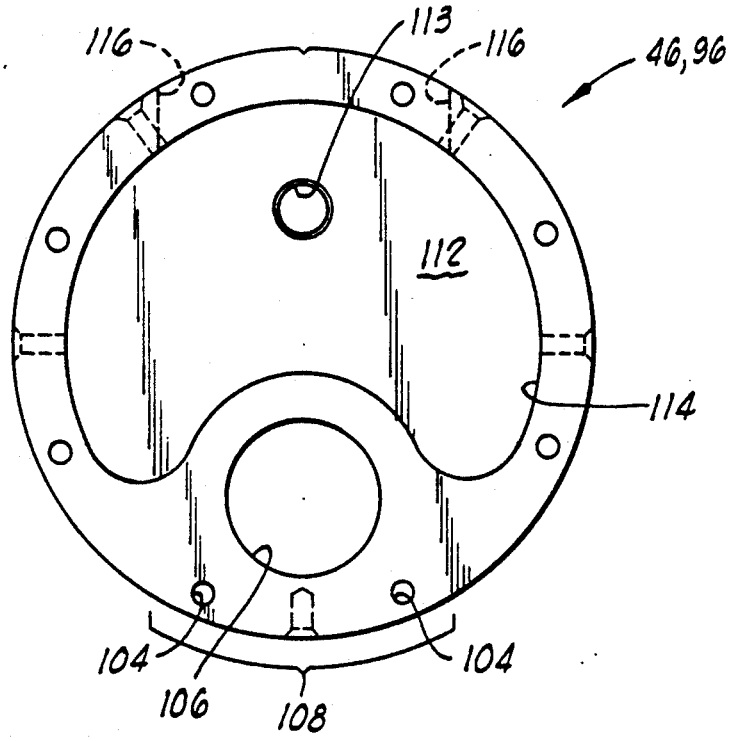
FIG. 11 is a bottom view of the tank bottom structure of FIG. 10.

In FIG. 2 a portion of the side wall of tank bottom structure 96 indicated generally at 107 in FIG. 11 has been broken away so that the interior of opening 106 is visible. The pump discharge outlet nipple 45 of discharge pump 40 is visible extending upward into the opening 106. The check valve 108 is attached to the upper end of discharge nipple 45. Check valve 108 permits flow of fluid from the pump 40 up into the tank 46 but does not allow fluid from the tank 46 to drain back into the pump discharge outlet 44.

The tank bottom structure 96 includes a solid upper wall 112 which defines a solid bottom across the pipe section 94. Upper wall 112 is welded to the bottom end of pipe section 94. Two openings extend through the upper wall 112, namely the opening 106 previously mentioned and a smaller threaded opening 113 which as further described below is connected to a drain apparatus for draining the tank 46.

Figure 10:
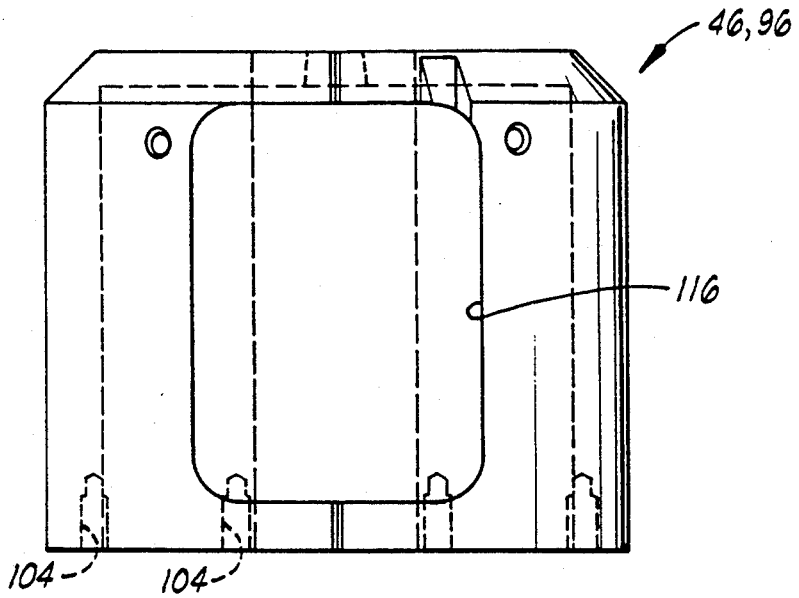
FIG. 10 is an elevation view of a tank bottom structure oriented as seen in FIG. 1.

As seen in FIG. 11, there is a crescent-shaped cavity 114 defined in tank bottom structure 96 which is accessible through a window 116 defined in the side wall of bottom structure 96 as best seen in FIG. 10.

As seen in FIG. 1, the window 116 provides access to the cavity 114 in which is located a drain assembly. A drain nipple 118 is threadedly connected to opening 113, and a drain valve 120 is attached to nipple 118. An elbow 122 is attached to the other side of valve 120 and provides a means for attachment of a drain hose or the like when the apparatus 10 has been pulled out of the tension leg. Thus, to drain liquid from the tank 46 after the apparatus 10 is removed from the tension leg 18, a drain hose is attached to elbow 122 and the valve 120 is opened to allow the tank 46 to drain.

An electrical float switch 110 is also located within crescent-shaped cavity 114 and it closes a switch which provides a signal to the surface through wireline 51 to indicate when the pump 40 is immersed in water. The float switch may be a Revere Aerospace Model 510 float switch no. 604380-A available from Revere Aerospace Company of 845 North Colony Road, Wallingford, Conn. 06492.

The float switch 110 which senses the presence of water at the level of tank bottom structure 96 exterior of the apparatus 10 may be utilized in several ways. It may be wired strictly as an indicator switch so as to give an indication at the surface of the presence of water surrounding the apparatus 10. That may be used in conjunction with manual on/off controls for electrical power to the pump 40 so as to turn the pump 40 on and off when desired. Also, the float switch 110 may be wired as an automatic on/off switch so that it automatically turns the pump 40 on when it is immersed in water and automatically turns off when the pump is either lifted out of the water or all of the water is taken into the pump inlet.

A small vent hole 124 (see FIG. 2) is provided through the pipe member 94 near its upper end to allow air to vent from the tank 46 as the same is filled, and also to allow air to vent into the tank 46 as the same is drained.

Figure 12:
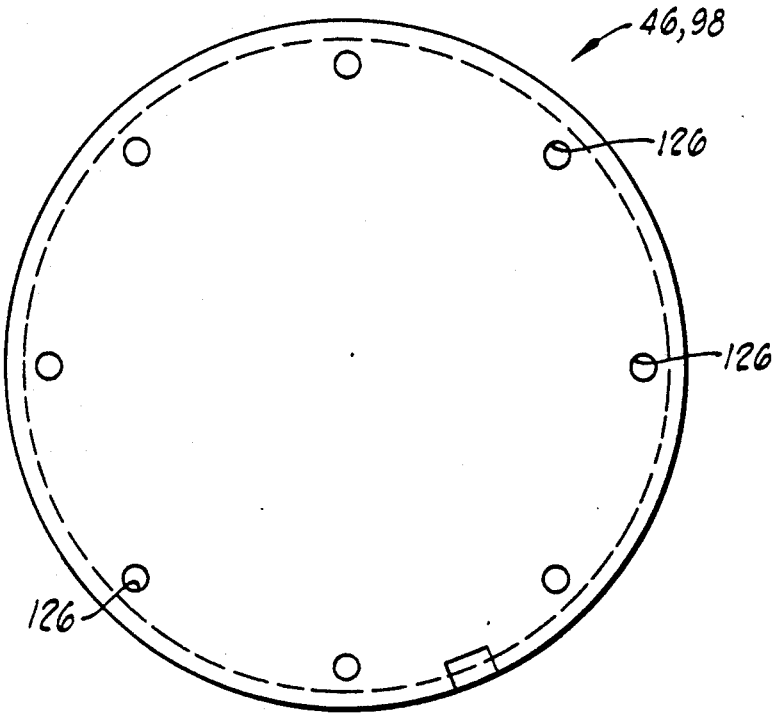
FIG. 12 is a plan view of a tank top plate.

The tank top plate 98 is seen in FIG. 12 and is a flat circular plate which carries a plurality of bolt holes 126 for receiving bolts 128 (see FIG. 2) which attach the wireline adapter 50 to the tank top plate 98. As previously mentioned, top plate 98 is welded to the upper end of pipe section 94.

A plurality of longitudinally extending bumper strips 130 extend along the outer length of pipe section 94 to prevent abrasion of the interior of the tension leg 18. One bumper strip 132 is formed as a conduit bumper strip 132 which provides a passageway for electrical wiring such as 134 which extends from the wireline 51 down to motor 40, switch 110, and any other electrical components of the apparatus 10 located below pipe section 94.

In FIG. 1 a portion of the wall of wireline adapter spool 50 is cut away to show electrical connectors 136 which may be utilized to make a disengagable connection between the electrical wiring of wireline 51 and the wiring 134 of the apparatus 10. An annular plastic bumper 131 is disposed on the upper end of adapter spool 50.

The adapter spool 50 has a flange at its lower end which has a lateral opening therethrough communicating the interior of adapter spool 50 with the interior of conduit bumper 132 to allow wiring to extend therethrough.

An annular bumper 138 is disposed around the upper edge of tank bottom structure 96.

All of the bumpers 131, 130, 132, 138, 90 and nose piece 52 may be generally described as non-metallic bumper means attached to an exterior of the pump and storage tank for preventing scuffing of an inner wall of the tension leg 18 into which the apparatus 10 is lowered on wireline 51. The tension leg 18 is a critical structural member which is subjected to severe cyclical loading. If the apparatus 10 were allowed to scrape or nick the interior of tension leg 18, that could create points of stress concentration which could lead to premature failure of tension leg 18.

METHODS OF OPERATION

There are several situations in which it may be necessary to remove water from the hollow interior of one of the tension legs 18 of platform 12 of FIGS. 13–15.

For example, during the execution of certain maintenance and inspection operations on such tension legs, which operations are described in detail in U.S. patent application Ser. No. 07/701,698 of Warren et al. entitled APPARATUS AND METHOD FOR INSPECTING A TUBULAR STRUCTURE, attorney docket ICR 90/091, and U.S. patent application Ser. No of 07/701,230 of Brook et al. entitled APPARATUS AND METHOD FOR ULTRASONIC INSPECTION, both filed concurrently herewith, small amounts of water may be introduced into the leg interior and collect in the bottom of the tension leg 18. Additionally, this water may be contaminated with small particulate matter and sometimes with larger debris such as welding rods, rope and the like which may be accidentally dropped into the tension leg. Removal of this water may be necessary in order to provide unobstructed access to all welds of the tension leg in order to permit both internal visual and ultrasonic inspection thereof. Additionally, removal of the water is critical in order to prevent internal corrosion of the tension leg 18 which is of course a very critical load carrying structure.

Furthermore, the tension leg 18 may be damaged thus allowing water to leak into the leg. Removal of the water from the leg interior is essential before the tension leg 18 can be disconnected and removed from the tension leg platform 12 and anchored framework 30.

Since the interior of tension leg 18 is of varying diameter, the apparatus 10 must be constructed to dimensions which permit it to traverse the entire length of the tension leg 18. One embodiment of the tension leg 18 which has been constructed and is in service by the assignee of the present invention in the Green Canyon of the Gulf of Mexico has internal dimensions of the larger intermediate portion 36 of twenty-two inches, and internal diameter of the upper and lower tendon leg sections 32 and 34 of nine inches inside diameter. Accordingly, the apparatus 10 preferably has a maximum outside diameter slightly less than nine inches so that it can traverse all portions of the tension leg 18. The entire apparatus 10 has a length of approximately twenty feet. The tank 46 has a capacity of approximately thirty-five gallons.

FIGS. 16–19 sequentially illustrate a method of dewatering the interior of the hollow tension leg 18 connecting the tension leg platform 12 to the floor 14 of the body of water 16.

Figure 17:
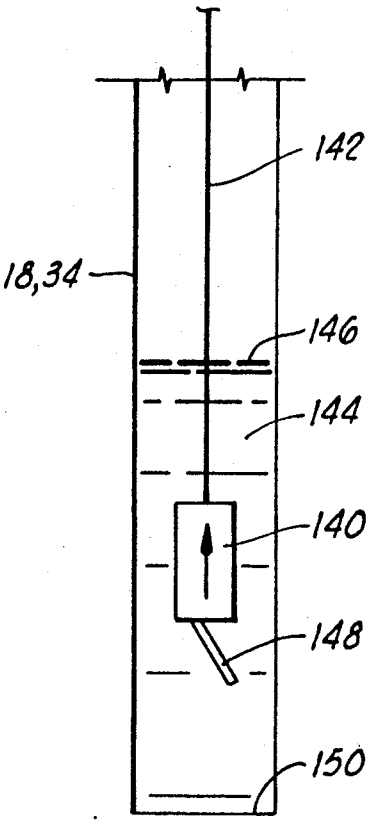
Figure 16:
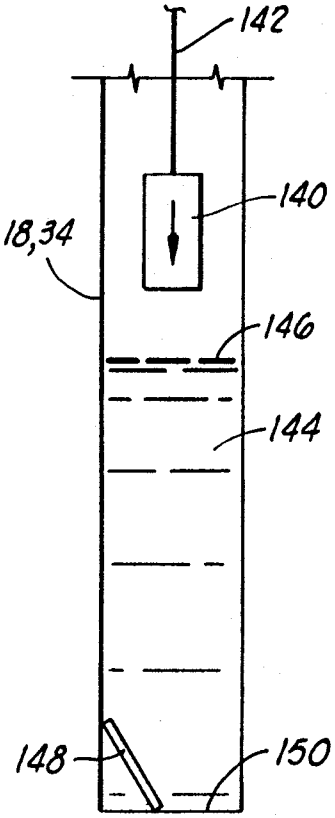

FIGS. 16 and 17 illustrate the steps of removing solid debris from the interior of the tension leg before the apparatus 10 is run into the tension leg to remove water therefrom.

In FIG. 16, a solid material removal apparatus 140 is shown being lowered on a wireline 142 into the tension leg 18. Water 144 is illustrated as being present in the leg 18 up to a level 146. Solid debris as represented by a welding rod 148 is shown resting on a bottom 150 of the tension leg 18.

The solids removal apparatus 140 may be a conventional sand pump such as that manufactured by The Cavins Company of 2853 Cherry Avenue, Long Beach, Calif., and designated as its sand pump Model "C" 3 ¾ inch outside diameter. Preferably the standard Cavins sand pump is utilized with a junk basket connected on the lower end thereof. A fishing magnet (not shown) may also be utilized prior to the sand pump to remove ferritic debris. Non-metallic bumpers may be attached to the sand pump and/or to the fishing magnet to prevent scuffing of the interior of tension leg 18.

The Cavins sand pump basically operates as follows. A pump plunger can be reciprocated by raising and lowering the wireline. Located below the plunger is a junk basket into which fluid and solid debris will be swept when the pump plunger is drawn upwards. When the plunger is drawn upwards fluid within the well is sucked into the junk basket and may be trapped therein by various means.

FIG. 16 schematically illustrates the Cavins sand pump 140 being lowered into the tension leg 18. It is lowered to the bottom of the leg 18 and then operated to draw the solid debris 148 into the junk basket.

FIG. 17 schematically illustrates the Cavins sand pump 140 being withdrawn from the tension leg and withdrawing with it the solid debris 148. The removal of solid debris is necessary prior to using apparatus 10, because the pump 40 cannot handle particulate material greater 3/16" in size.

After the solid debris has been removed from the tension leg 18, the apparatus 10 is utilized to dewater the tension leg 18.

The apparatus 10 is lowered into the leg 18 and preferably lowered until it rests on or near the bottom 150 of tension leg 18. Then the electric motor of pump 40 is turned on to pump water 144 through pump 40 up into the tank 46. The pump may be run for a predetermined period of time, for example, two minutes, which is sufficient to fill the tank 46, and then the pump 40 may be turned off. Then apparatus 10 is raised approximately twenty feet above the bottom 150 and the pump 40 is cycled on and off twice to make certain that the flapper check valves 72 and 74 are seated.

Figure 19:
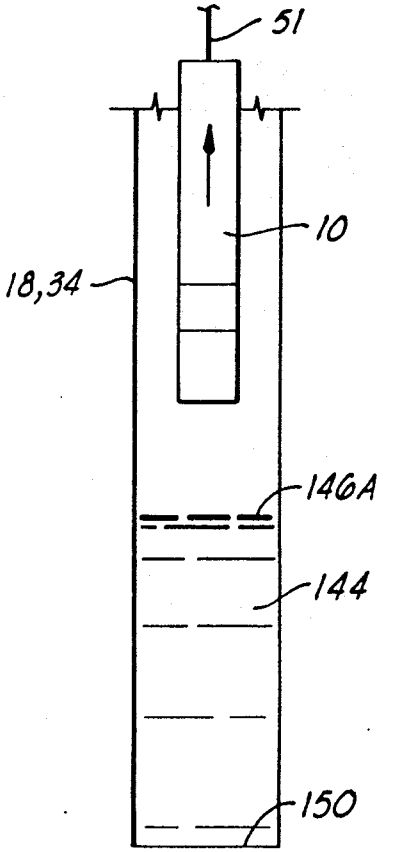
FIGS. 16–19 comprise a sequential series of schematic elevation views of a tension leg having solid debris and liquids removed therefrom by the methods of the present invention.
Figure 18:
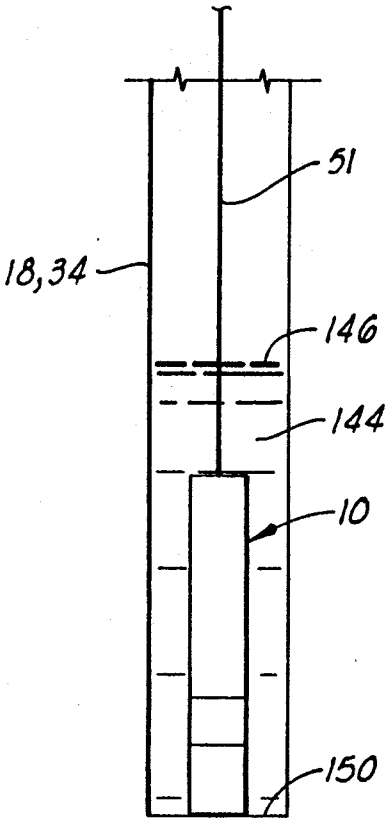

Then, the apparatus 10 is retrieved from the tension leg 18 as schematically illustrated in FIG. 19, thus removing water from the tension leg 18 and lowering the level of the water to level 146A as shown in FIG. 19. The apparatus 10 is completely removed from tension leg 18 and the tank 46 is then drained with valve 120. The steps illustrated in FIGS. 18 and 19 may then be repeated as necessary until the water 144 is substantially completely removed from the tension leg 18.

The design of the apparatus 10 is such that substantially all of the water can be removed from tension leg 18. First it is noted that the pump suction inlet 42 and the inlet shoe 58 are located adjacent the lower end of the apparatus 10 so that they may substantially engage the bottom end 150 of tension leg 18. The flapper valves 72 and 74 will prevent fluid from draining out of the pump 40 and the check valve 108 prevents fluid from draining out of the tank 46 so that substantially all of the water which enters the apparatus 10 will remain therein and be withdrawn with the apparatus 10. Furthermore, since the apparatus 10 is constructed to have an outside diameter only slightly less than the inside diameter of the lower portion 34 of tension leg 18, substantially all of the liquid in the very bottom portion of tension leg 18 will be displaced by the apparatus 10 when it is lowered to the bottom 150 of tension leg 18.

It is noted that in the broadest aspects of dewatering of tension legs, the dewatering procedure could be performed with pumping apparatus that does not include a tank. For example, a pump similar to that described above could be connected to tubing, preferably flexible hose or coil tubing, leading to the upper end of the tension leg 18 and the water could be pumped continuously through the tubing.

Also as previously mentioned, it may be necessary to dewater a tension leg 18 in conjunction with the removal of the tension leg 18 for repair or replacement. The structural design of the tension legs 18 is such that they must be empty when they are moved. Thus, a damaged tension leg 18 must be dewatered before it can be disconnected and removed from the platform 12. The dewatering of the tension leg 18 would be accomplished as described above with regard to FIGS. 16–19. Then, the tension leg 18 would be disconnected and removed from the tension leg platform 12 in a procedure which is substantially the reverse of the installation procedure illustrated in U.S. Pat. No. 4,844,659 to Hunter et al. at FIGS. 2A–2F thereof, the details of which are incorporated herein by reference.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method for dewatering an interior of a hollow tension leg connecting a tension leg platform to a floor of a body of water comprising:

(a) lowering an elongated pump and storage tank assembly into said interior of said hollow tension leg;

(b) pumping water from said interior into said storage tank with said pump; and (c) retrieving said pump and storage tank assembly from said hollow tension leg thereby removing water from said interior of said hollow tension leg.

2. The method of claim 1, further comprising:

prior to steps (a) through (c), removing solid debris from said interior of said hollow tension leg to prevent said debris from interferring with operation of said pump.

3. The method of claim 1, wherein said dewatering step further comprises:

(d) after step (c), emptying said storage tank.

4. The method of claim 3, further comprising:

repeating steps (a) through (d) as necessary until substantially all of said water is removed from said interior of said hollow tension leg.

5. The method of claim 1, wherein:

said step (a) is further characterized in that said pump and storage tank assembly has a pump suction inlet located on a lower end of said assembly; and said step (a) is performed with said pump suction inlet located adjacent a bottom of said interior of said hollow tension leg.

6. The method of claim 1, wherein:

said step (a) is further characterized in that said pump and storage tank assembly has a pump suction inlet located on a lower end of said assembly and said storage tank is located above said pump.

7. The method of claim 1, wherein:

said step (a) is further characterized as lowering said pump and storage tank assembly on a wireline.

8. The method of claim 7, wherein:

said step (a) is further characterized in that said pump is an electric pump which receives power through said wireline.

9. The method of claim 1, further comprising:

prior to step (a), sensing the presence of water surrounding said pump and storage tank assembly.

10. The method of claim 1, further comprising:

during said step (a), preventing water from draining out of said storage tank.

11. The method of claim 10, further comprising:

during said step (a), preventing water from draining out.

12. An apparatus for removing liquids from an elongated tubular member, comprising:

a pump having a suction inlet and a discharge outlet, said suction inlet being defined on a lower end of said pump;

an elongated storage tank attached to said pump and located above said pump and having a tank interior communicated with said discharge outlet; and wireline connector means for connecting said pump and storage tank to a wireline so that said pump and storage tank can be lowered and raised with said wireline.

13. The apparatus of claim 12, further comprising:

check valve means located between said pump discharge outlet and said tank interior for preventing flow back from said tank interior into said pump discharge outlet.

14. The apparatus of claim 12, further comprising:

vent means for venting air from an upper portion of said storage tank as said tank interior fills with liquid.

15. The apparatus of claim 12, further comprising:

drain valve means for draining said tank interior.

16. The apparatus of claim 12, further comprising:

non-metallic bumper means attached to an exterior of said pump and said storage tank for preventing scuffing of an inner wall of said tubular member into which said apparatus is lowered on said wireline.

17. The apparatus of claim 16, wherein:

said bumper means includes a bumper conduit for providing a passage for electrical wiring from said wireline such that any electrical wiring is kept external to said storage tank.

18. The apparatus of claim 12, further comprising:

sensor means for sensing when said pump is immersed in liquid.

19. The apparatus of claim 12, further comprising:

check valve means adjacent said suction inlet of said pump for preventing liquid from draining from said pump.

20. A method, comprising:

(a) lowering a pump into an interior of a hollow tension leg connecting a tension leg platform to a floor of a body of water;

(b) preventing scuffing of said interior of said hollow tension leg by providing said pump with non-metallic bumpers on an exterior thereof; and (c) dewatering said interior of said hollow tension leg by pumping water out of said interior with said pump.

21. The method of claim 20, wherein:

said step (b) is further characterized as preventing the creation of stress concentrations on said interior and thereby preventing failure of said tension leg.

22. The method of claim 20, further comprising:

prior to step (a), removing solid debris from said interior of said hollow tension leg to prevent said debris from interferring with operation of said pump.

23. The method of claim 20, wherein:

said step (a) is further characterized in that said pump has a pump suction inlet located on a lower end of said pump; and said step (c) is performed with said pump suction inlet located adjacent a bottom of said interior of said hollow tension leg.

24. The method of claim 20, wherein:

said step (a) is further characterized as lowering said pump on a wireline.

25. The method of claim 24, wherein:

said step (a) is further characterized in that said pump is an electric pump which receives power through said wireline.

26. The method of claim 20, further comprising:

prior to said step (c), sensing the presence of water surrounding said pump.

27. The method of claim 20, further comprising:

(d) retrieving said pump out of said interior of said hollowing tension leg; and (e) during said step (d), preventing water from draining out of said pump.

* * * * *